United States Patent [19]

Nouwens

[11] Patent Number: 4,901,678

[45] Date of Patent: Feb. 20, 1990

[54] HEATING BOILER AND METHOD FOR OPERATING SAME

[75] Inventor: F. H. C. Nouwens, Hilvarenbeek, Netherlands

[73] Assignee: Econosto N.V., Netherlands

[21] Appl. No.: 267,096

[22] Filed: Nov. 3, 1988

[30] Foreign Application Priority Data

Nov. 4, 1987 [NL] Netherlands ..... 8702627

[51] Int. Cl.[4] ..... F22B 37/42

[52] U.S. Cl. ..... 122/504.2; 165/11.1; 236/14; 431/16

[58] Field of Search ..... 122/379, 504.2; 110/189, 193; 431/16, 19; 165/5, 11.1, 95, 40; 236/14

[56] References Cited

U.S. PATENT DOCUMENTS

| | | | |
|---|---|---|---|
| 3,831,561 | 8/1974 | Yamamoto et al. | 122/379 |
| 4,102,627 | 7/1978 | Reed et al. | 431/16 |
| 4,488,516 | 12/1984 | Bueters et al. | 122/379 |
| 4,615,302 | 10/1986 | Wynnyckyj et al. | 122/504.2 X |
| 4,677,357 | 6/1987 | Spence et al. | 110/189 X |

*Primary Examiner*—Edward G. Favors

*Attorney, Agent, or Firm*—Watson, Cole, Grindle & Watson

[57] ABSTRACT

A fan forces air through an air inlet channel to a mixing chamber where it is mixed with fuel, and the mixture is then fed to a burner. The combustion products of the burner provide heat to a heat exchanger which is connected to a discharge channel. The contamination of the system is measured, and the speed of the fan is increased upon an increase in the contamination. The heating system is automatically prevented from operating when the contamination exceeds a predetermined value.

16 Claims, 4 Drawing Sheets

HEATING BOILER AND METHOD FOR OPERATING SAME

Service in heating boilers takes place regularly, for instance annually. The main reason for service is contamination of burner, heat exchanger and/or discharge channel.

Such service is cumbersome and costly. Further more and more separate domestic central heating boilers are used in appartment buildings, often one for each appartment; the (single) inhabitant of such an appartment will have to be home during such service.

The present invention has for its object to improve upon known heating boilers, such as are known from e.g. NL-A-No. 7907138 and DE-A No. 2011717.

Therefore the present invention provides a heating boiler according to claim 1.

Preferrably the means for measuring the degree of contamination are connected to indication means and/or means for increasing the number of revolutions of the fan, whereas the user of the heating boiler knows when services has to take place and/or the boiler maintains efficient operation even after a certain degree of contamination has been reached.

such heating boilers are known among others under the name of high-efficiency central heating boilers. During operation the boiler will contaminate particularly the feed channel, burner, heat exchanger and discharge channel. In order to prevent an unacceptable level of contamination it is usual to clean the boiler periodically, for example annually. The rate of contamination is greatly dependent on boiler construction, intensity of use, temperature level of the exhausted combustion gases, contamination of the combustion air (chlorine compounds, atmospheric dust) and contamination of the fuel sulphur compounds, so that the length of the period between times when cleaning must take place can in no way be reliably predicted. In order to prevent the contamination of the boiler exceeding the maximum permissible value the period between cleanings is therefore generally shorter than necessary. This has the drawback however that the boiler is cleaned more frequently than necessary, which needlessly increases the maintenance costs of the boiler.

The present invention will be described hereinafter referring to the description of embodiments thereof, in which reference is made to a drawing wherein.

Yet another embodiment of the invention is characterized in that the heating boiler is furnished with means for determining the mass flow of air in the feed channel and with a comparing circuit for comparing the required mass flow with a minimum reference value and for generating a blocking signal if the determined mass flow is lower than the reference value, and with means for preventing in reaction to the blocking signal the heating boiler being set into operation. This embodiment has the advantage, in the case the contamination indication signal is ignored for a long period, that it prevents the heating boiler being kept in operation when there is an excessive measure of contamination of the burner, which would lead to unsafe situations developing.

Figure 1:
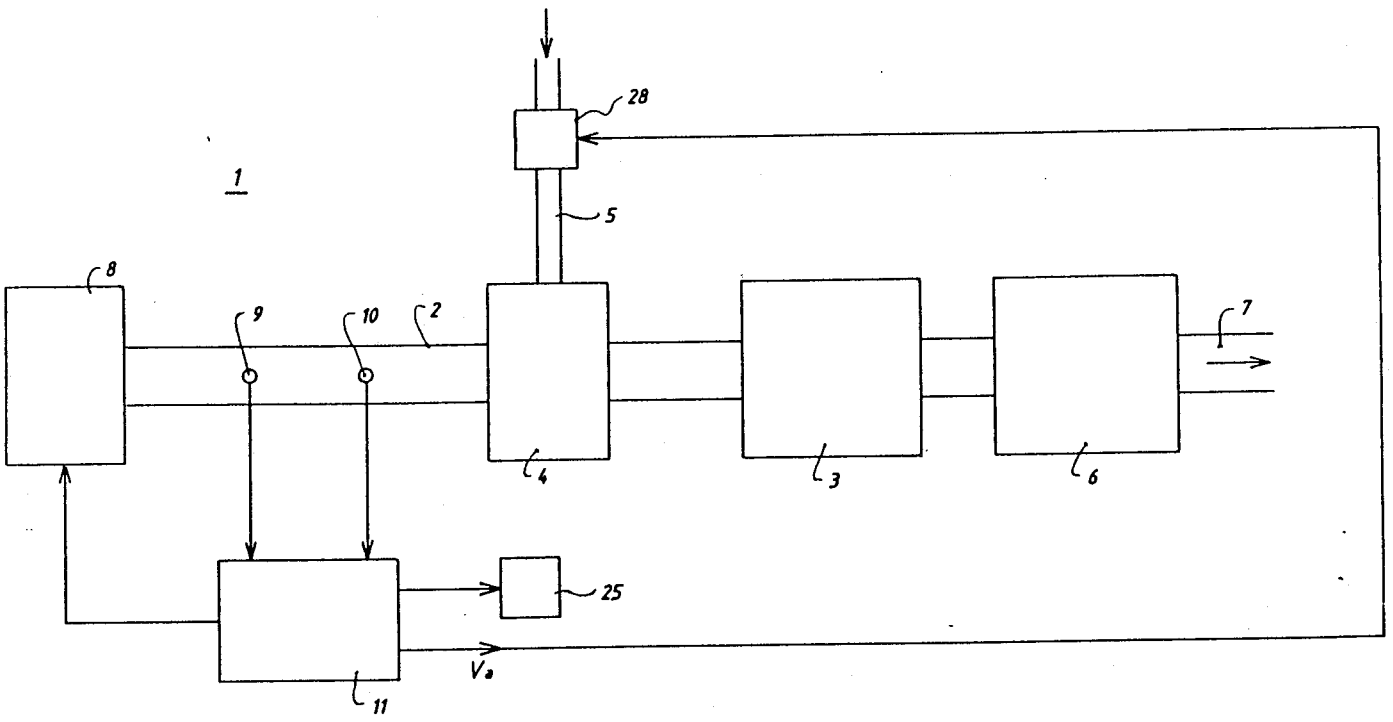
FIG. 1 shows a prefered embodiment of a heating boiler according to the present invention.
Figure 2:
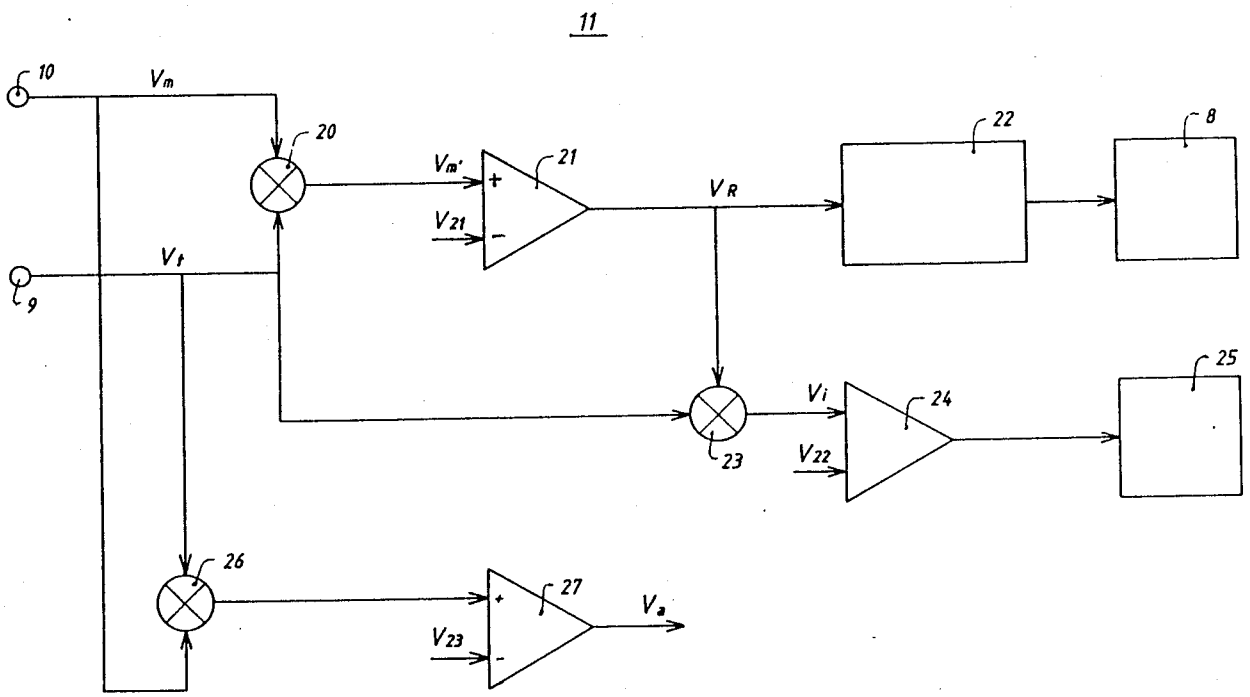
FIG. 2 shows in more detail block 11 from FIG. 1.
Figure 3:
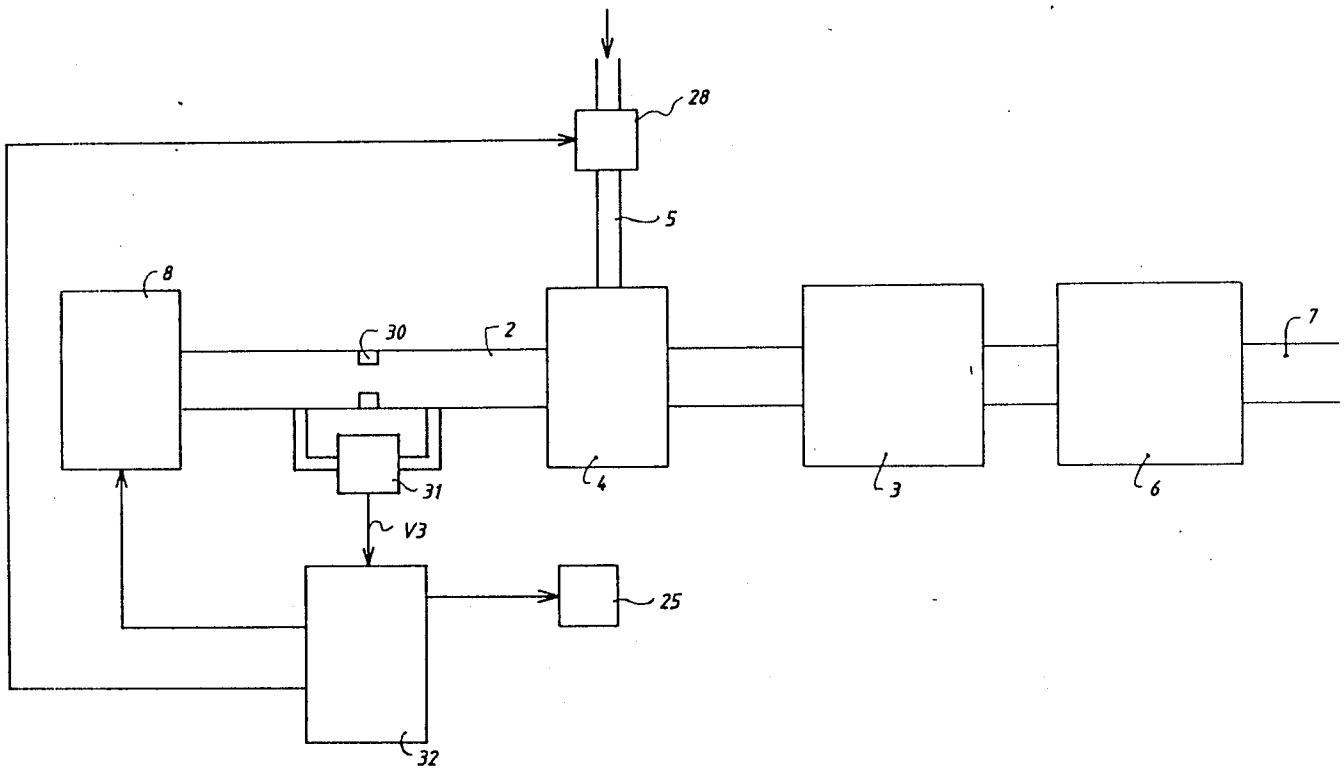
FIG. 3 shows a second prefered embodiment of the present invention.
Figure 4:
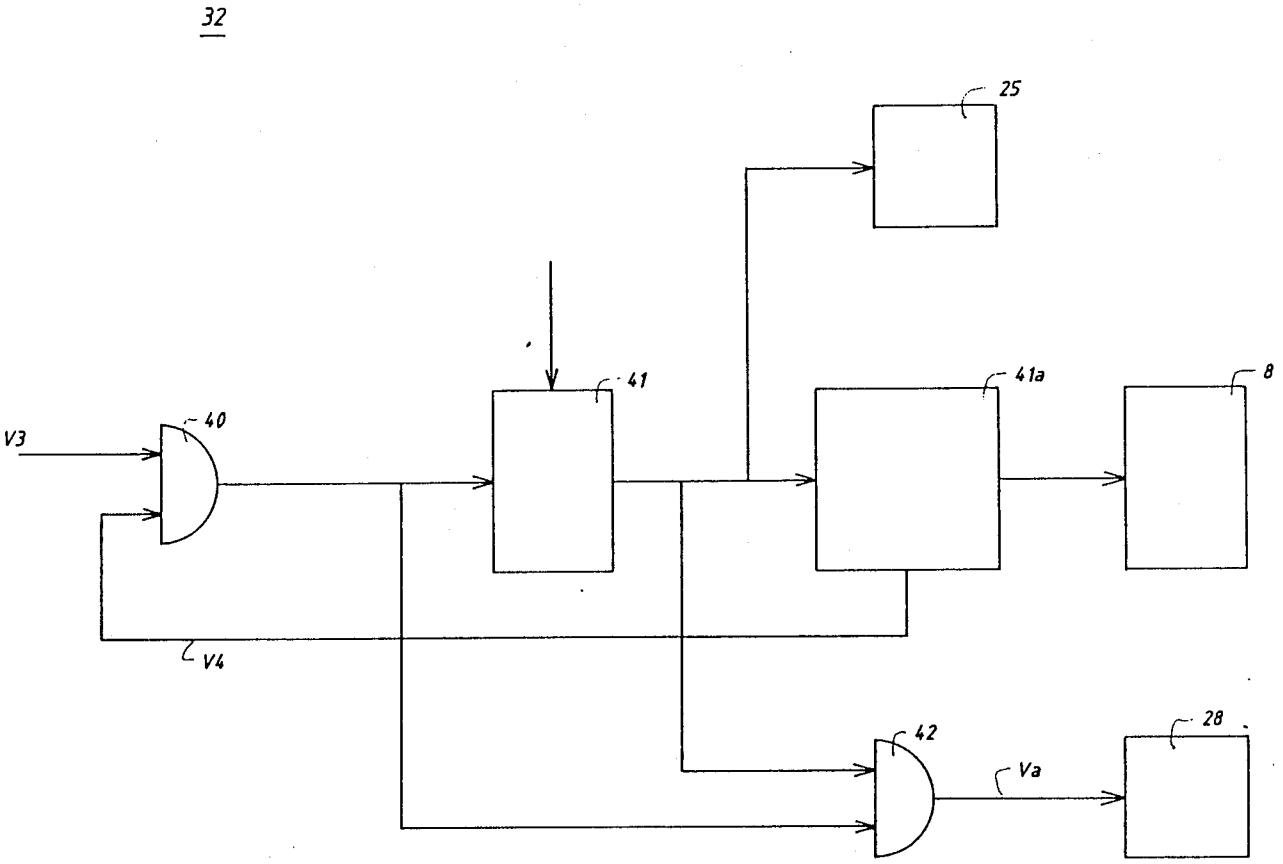
FIG. 4 shows in more detail block 33 from FIG. 3.

Embodiments of the heating boiler as well as further advantages thereof are described in detail hereinafter with reference to the FIGS. 1–4, whereby FIGS. 1 and 3 show schematic embodiments of the heating boiler according to the invention and FIGS. 2 and 4 embodiments of the electronic circuit employed in the heating boiler according to the invention.

FIG. 1 shows schematically an embodiment of a heating boiler 1. Heating boiler 1 comprises a feed channel 2 for supply of the air to a burner 3. Placed in feed channel 2 is a mixing member 4 for mixing the supplied air with a normal fuel in gas form, which is added to mixing member 4 via a fuel feed channel 5. The thus formed flammable mixture of gaseous fuel and air is burned in burner 3. The thereby formed combustion gases are passed along one or more heat exchangers 6, whereby the heat stored in the combustion gases is transferred to a heating medium, for instance water or air. The combustion gases cooled in the heat exchanger(s) 6 are carried away via a discharge channel 7.

In order to bring about an air flow via feed channel 2, a pressure difference is generated between the entrance of the feed channel and the discharge channel using a fan 8 placed at the entrance of feed channel 2. Using the closed loop control system, which comprises a temperature detector 9, a mass flow detector 10, for example the detector of the FM 713 type supplied by SARASOLA, an electronic circuit 11 and the fan 8, the mass flow of air is held substantially constant.

FIG. 2 shows an embodiment of the electronic circuit 11. The temperature signal Vt generated by the temperature detector 9 and representing the temperature of the air in feed channel 2 is fed together with the mass flow signal Fm, which is generated by the mass flow detector 10 and which represents the mass flow of air in feed channel 2, to a compensating circuit 20. Compensation is made using the compensating circuit 20 for the effect of temperature on the mass flow measurement by detector 10. The compensated mass flow signal Vm is fed to the non-inverting input of a differential amplifier 21. Fed to the inverting input of differential amplifier 21 is a reference signal Vrl, representing the desired value of the mass flow. Differential amplifier 21 serves as regulator, and generates at its output a control signal Vr which is fed to an actuating circuit 22 for actuating of the fan 8 in accordance with the amplitude of control signal Vr.

Using the above described closed loop control circuit the number of revolutions of fan 8 is always adjusted such that the mass flow of air in the feed channel is held substantially constant. If the measure of contamination increases, the pressure difference generated by fan 8 for effecting of the air supply to burner 3 will increase. This pressure difference therefore contains information concerning the measure of contamination. The required pressure difference is determined not only by the measure of contamination but also by the temperature of the supplied air. The specific gravity of air is higher at a lower temperature than at a higher temperature, which results in an increase of the pressure difference required when the air temperature increases.

As the required pressure difference is determined substantially by the air temperature and the measure of contamination of the boiler, a measure for the contamination of the boiler can be derived through a temperature-dependent adjustment of a measure for the pressure difference, for instance by means of a linear combination of the measure for the pressure difference and a measure for the air temperature.

It will be apparent that the measure for the pressure difference can be determined in very many ways, for example by a pressure difference meter of a usual type which measures the pressure difference over the dam member. A useful measure for the pressure difference which is already available in the case of the use of a closed loop control system for keeping the mass flow of air constant is the control signal Vr. In the embodiment shown in FIG. 2, using a compensating circuit 23 a contamination indication signal Vi, which indicates the measure of boiler contamination, is derived by means of the linear combination of the temperature signal and the control signal. The contamination indication signal Vi is compared using a comparator 24 with a reference signal Vr2 representing the measure of contamination whereby cleaning of the boiler is desirable.

As soon as the measure of contamination given by the contamination indication signal Vi exceeds the said reference value a signal is emitted which indicates that cleaning of the boiler is desirable. This signal consists preferably of a light and/or sound signal which is emitted by the indicator 25 controlled by the output signal of comparator 24. A particularly suitable signal is a sound signal which ceases after a determined period and which is combined with a permanently generated light signal.

If the user ignores the signal emitted by the indicator 25 contamination of the burner will increase until the time that the contamination has assumed a form such that keeping the heating boiler in operation is no longer responsible for reasons of safety. Such an unsafe situation can be derived from the mass flow signal Vm and the temperature signal Vt by means of a linear combination of the mass flow signal Vm and the temperature signal Vt performed by means of a compensating circuit 26. The signal thus obtained at the output of compensating circuit 26 is compared using a comparator 27 with a reference signal Vr3. The output signal Va can be used as alarm signal in order to prevent the heating boiler being set into operation, for instance by means of an electrically controllable valve 28 placed in the fuel supply channel 5.

It should be noted that the invention is in no way limited to the above described embodiment. So for example the fan for effecting the pressure difference may be placed at the exit of the discharge channel instead of at the entrance to the feed channel. Nor is it necessary for the temperature detector to be placed in the feed channel. It is also possible to place the air temperature detector outside the feed channel, for example before the suction opening of the fan.

FIG. 3 shows yet another embodiment of the heating boiler according to the invention. The element in FIG. 3 corresponding with the elements shown in FIG. 1 are designated with the same reference numerals. Placed in feed channel 2 is a dam member 30. A pressure difference detector 31 of a normal type detects the pressure difference over the dam member 30 and generates an electrical signal V3, if the detected pressure difference is lower than a determined minimum value. The signal V3 is fed to an electronic circuit 32. This latter comprises a dual input EN gate 40 (see FIG. 4) to which the detection signal V3 is fed. Fed to the other input of the EN gate is a signal V4 which indicates that the fan is switched on. The signal V3 can be generated by a fan control circuit 41 for the actuating of the fan motor. The output signal of the EN gate 40 is fed to a memory circuit, for instance a flip-flop 41, which in reaction to a "0–1" change of the output signal of the EN gate 40 is loaded with a logical l signal which is fed via an output of the flip-flop 41 to the fan The fan control circuit 41A becomes a two-stage control circuit which during normal operation drives the fan 8 at a first number of revolutions and which, in reaction to a logical 1 signal to the output of the flip-flop, drives fan 8 at a second number of revolutions that is higher than the first number of revolutions. The output signal of flip-flop 41 is further fed to the indicator 25 and via a dual input EN gate 42 to the electrically controlled valve 28 in the fuel supply channel 5. Fed to the other input of the EN gate 42 is the output signal of the EN gate 40.

The operation of circuit 32 is as follows:

When the boiler is clean the air flow through the feed channel 2 is sufficiently high with a low number of revolutions of the fan to generate over the dam member 30 a pressure difference that lies above the predetermined minimum value. As contamination of the boiler increases the air flow will decrease, whereby the pressure difference over dam member 30 likewise falls.

As soon as the pressure difference has fallen below the predetermined minimum value, flip-flop 41 is loaded with a logical 1. As a result the indicator 25 will generate the alarm signal. The fan drive circuit 41a will moreover increase the number of revolutions of fan 8 so that the air output of the fan will increase and a sufficiently large air flow to burner 3 is thus maintained. In the case of a possible incidental malfunction it can occur that the flip-flop 41 is wrongly placed in the logical 1 state. In order to prevent an erroneous signal being generated for a long period as a result, the flip-flop 41 can be set periodically to nought, for example each time the burner 8 is switched off. If after the increase in the number of revolutions of the fan 8 as a result of failure over a long period to carry out a service cleaning the contamination of the boiler has increased in such measure that even with the increased speed of revolution the pressure difference over the boiler drops below the stated minimum value, the blocking signal Va is then generated at the output of the EN gate 42, as a result of which the fuel supply is blocked by means of valve 28, thus preventing the setting into operation of a boiler that from a safety viewpoint is contaminated to an irresponsibly high level.

A two-stage fan drive circuit is employed in circuit 32. It will be apparent to one skilled in the art that such a circuit can equally well be executed with a three or more stage fan drive circuit or even a continuously adjustable fan drive circuit.

The electronic circuits 11 and 32 take the form in the embodiments described of "hard-ware" circuits. It will however be apparent to one skilled in the art that these circuits can equally well be formed using programmable circuits such as microprocessors.

Finally, it is remarked that the adjustment of the air output for the fan is realized by adjustment of the number of revolutions. This air output can however also be adjusted in other ways, for instance by a controllable valve placed in the feed channel.

Advantages of the described preferred embodiments over the prior art include:

service can be planned according to certain, e.g. local, circumstances, e.g. less service in case of a relatively clean fluid, such as natural gas from Holland;

ample time for calling in service assistance is provided for user of the heating boiler to call in service assistance, after indication has been given that service is needed;

damage due too many revolutions per time unit of the fan is prevented by the blocking signal; and the (hardware) system for controlling the flow and air and therefore the operation of the heating boiler, is relatively simple and compact.

I claim:

1. A heating system comprising a burner for the combustion of a mixture of air and fuel, a feed channel for feeding said burner, a discharge channel for discharging combustion products from said burner, a heat exchanger to be heated by said burner, means for determining the degree of contamination of said system, a fan for maintaining a pressure difference between said feed and discharge channels and means for increasing the number of revolutions of the fan connected to the means for determining the degree of contamination, such that when the degree of contamination exceeds a predetermined degree the number of revolutions of the fan is increased.

2. A heating boiler as claimed in claim 1, provided with blocking means for blocking the increase of the number of revolutions of the fan, when the degree of contamination exceeds a predetermined maximal value.

3. A heating boiler as claimed in claim 1 or 2, in which the heating boiler is provided with a control system for maintaining the airflow in said feed channel substantially at a constant value.

4. In a heating system including a burner having an upstream air inlet channel, a downstream heat exchanger and a combustion products outlet channel, means for forcing air through the inlet channel, the burner, the heat exchanger and the outlet channel and means for delivering fuel to the burner, the improvement comprising means for measuring resistance to the flow of air effected by the means for forcing air, and means for generating an alarm signal in response to measurement of resistance to flow of air which exceeds a predetermined value, the means for measuring resistance to flow of air including means for measuring the mass rate of air flow and means for measuring the temperature of air flowing from the means for forcing air.

5. In a heating system as defined in claim 4 wherein said means for generating an alarm signal includes a control circuit connected to the means for measuring the mass rate of flow of air and to the means for measuring the temperature of air flowing from the means for forcing air and having an output generating the alarm signal.

6. In a heating system as defined in claim 5 wherein the control circuit includes a first differential amplifier having a combined input from the means for measuring the mass rate of air flow and the means for measuring air temperature and a further input which is a first reference signal, and a second differential amplifier having a combined input from the means for measuring the mass rate of air flow and the means for measuring air temperature and a further input which is a second reference signal.

7. In a heating system as defined in claim 5 wherein the control circuit includes a first AND gate having one input from the means for measuring the resistance to air flow and another input indicating the means for forcing air is energized, and a second AND gate having one input which is the output of the first AND gate and another input which is the output of flip/flop means controlled by the means for measuring the resistance to flow of air.

8. A heating system comprising, a burner, an air inlet channel for feeding air to said burner, fuel feed means for feeding fuel to said burner, a heat exchanger heated by combustion products from said burner, an outlet channel for exhausting the combustion products, means for forcing air through said inlet channel, the burner, the heat exchanger and the outlet channel, measuring means for measuring resistance to the flow of air effected by the means for forcing air, and means operated by said measuring means for automatically preventing operation of the heating system when the resistance to the flow of air exceeds a predetermined value.

9. A heating system as defined in claim 8 wherein said means for preventing operation of the heating system comprises means for preventing the fuel feed means from feeding fuel to said burner.

10. A heating system as defined in claim 8 wherein said measuring means includes means for measuring the mass rate of air flow in said air inlet channel and means for measuring the temperature of the air.

11. A heating system as defined in claim 10 including means for maintaining the mass rate of air flow in said air inlet channel substantially constant.

12. A heating system as defined in claim 8 wherein said measuring means includes a dam means disposed in said inlet channel, and means for measuring the pressure difference on opposite sides of said dam means.

13. A heating system as defined in claim 8 wherein said means for forcing air through said inlet channel comprises a variable speed fan, and means for varying the speed of the fan in accordance with variations in the resistance to the flow of air measured by said measuring means.

14. In a heating system comprising, a burner, an air inlet channel for feeding air to said burner, fuel feed means for feeding fuel to said burner, a heat exchanger heated by combustion products from said burner, an outlet channel for exhausting combustion products, power operated means for forcing air through said inlet channel, the burner, the heat exchanger and the outlet channel;

the method of operating the system comprising, operating said power operated means to force air through said inlet channel and into said burner, operating said fuel feed means to feed fuel to said burner, measuring the resistance to the flow of air through the inlet channel, and automatically preventing the operation of the heating system when the measured resistance to the flow of air exceeds a predetermined value.

15. The method as defined in claim 14 wherein the step of preventing the operation of the heating system comprises the step of interrupting the feed of fuel to said burner.

16. The method as defined in claim 14 wherein the step of measuring the resistance to the flow of air provides measurements which have variations, and including the step of varying the speed of the power operated means in accordance with variations in said measurements.

* * * * *